US009613565B2

(12) United States Patent
Osame et al.

(10) Patent No.: US 9,613,565 B2
(45) Date of Patent: Apr. 4, 2017

(54) LIGHT EMITTING DEVICE

(75) Inventors: Mitsuaki Osame, Kanagawa (JP); Aya Anzai, Kanagawa (JP); Ryota Fukumoto, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1700 days.

(21) Appl. No.: 11/968,902

(22) Filed: Jan. 3, 2008

(65) Prior Publication Data

US 2008/0111776 A1 May 15, 2008

Related U.S. Application Data

(63) Continuation of application No. 10/630,939, filed on Jul. 31, 2003, now Pat. No. 7,352,133.

(30) Foreign Application Priority Data

Aug. 5, 2002 (JP) ..... 2002-228017

(51) Int. Cl.
*G09G 3/3225* (2016.01)
*G09G 3/20* (2006.01)
(Continued)

(52) U.S. Cl.
CPC ..... *G09G 3/3225* (2013.01); *G09G 3/2018* (2013.01); *G09G 3/3275* (2013.01);
(Continued)

(58) Field of Classification Search
USPC ..... 345/76, 92, 98
See application file for complete search history.

(56) References Cited

U.S. PATENT DOCUMENTS 3,909,788 A 9/1975 Kaelin
5,598,021 A 1/1997 O
(Continued)

FOREIGN PATENT DOCUMENTS

EP 0 776 147 5/1997
EP 0 883 191 12/1998
(Continued)

OTHER PUBLICATIONS

European Patent Office Communication for Application No. 03017899.0-2205 including Search Report; 3 pages; Jun. 3, 2004.
(Continued)

*Primary Examiner* — Amr Awad
*Assistant Examiner* — Andre Matthews
(74) *Attorney, Agent, or Firm* — Fish & Richardson P.C.

(57) ABSTRACT

An object of the present invention is to provide a light emitting device that is able to suppress power consumption while a balance of white light is kept, without making a configuration of a power source circuit complicated. A power source potential corresponding to each color of a light emitting element is used as a higher electric potential of a video signal and an electric potential of a power source line in the case that a transistor for controlling a supply of electric current to the light emitting element is a p-channel TFT. Conversely, a power source potential corresponding to each color of a light emitting element is used as a lower electric potential of a video signal and an electric potential of a power source line in the case that a transistor for controlling a supply of electric current to the light emitting element is an n-channel TFT.

18 Claims, 6 Drawing Sheets

(51) Int. Cl.

| | |
|---|---|
| ***G09G 3/3275*** | (2016.01) |
| *G09G 3/22* | (2006.01) |
| *G09G 3/32* | (2016.01) |

(52) U.S. Cl.

CPC ..... *G09G 3/22* (2013.01); *G09G 3/32* (2013.01); *G09G 2310/027* (2013.01); *G09G 2310/0289* (2013.01); *G09G 2330/021* (2013.01); *G09G 2330/028* (2013.01)

(56) References Cited

U.S. PATENT DOCUMENTS

| | | | | |
|---|---|---|---|---|
| 5,641,991 | A | 6/1997 | Sakoh | |
| 5,652,600 | A | 7/1997 | Khormaei | |
| 5,807,627 | A | 9/1998 | Friend | |
| 5,812,105 | A | 9/1998 | Van de Ven | |
| 5,882,761 | A | 3/1999 | Kawami | |
| 5,990,629 | A * | 11/1999 | Yamada et al. | 315/169.3 |
| 6,057,647 | A | 5/2000 | Kurosawa | |
| 6,147,667 | A | 11/2000 | Yamazaki | |
| 6,165,824 | A | 12/2000 | Takano | |
| 6,175,345 | B1 | 1/2001 | Kuribayashi | |
| 6,191,764 | B1 | 2/2001 | Kono | |
| 6,246,070 | B1 | 6/2001 | Yamazaki | |
| 6,255,705 | B1 | 7/2001 | Zhang | |
| 6,259,138 | B1 | 7/2001 | Ohtani | |
| 6,259,838 | B1 | 7/2001 | Singh | |
| 6,313,481 | B1 | 11/2001 | Ohtani | |
| 6,351,077 | B1 | 2/2002 | Koyama | |
| 6,373,455 | B1 | 4/2002 | Kuribayashi | |
| 6,380,688 | B1 | 4/2002 | Bae | |
| 6,392,617 | B1 | 5/2002 | Gleason | |
| 6,462,722 | B1 | 10/2002 | Kimura | |
| 6,479,333 | B1 | 11/2002 | Takano | |
| 6,501,227 | B1 | 12/2002 | Koyama | |
| 6,522,315 | B2 | 2/2003 | Ozawa | |
| 6,548,960 | B2 | 4/2003 | Inukai | |
| 6,576,926 | B1 | 6/2003 | Yamazaki | |
| 6,700,330 | B2 | 3/2004 | Koyama | |
| 6,760,004 | B2 | 7/2004 | Koyama | |
| 6,825,820 | B2 | 11/2004 | Yamazaki et al. | |
| 6,839,045 | B2 | 1/2005 | Ozawa | |
| 6,872,973 | B1 * | 3/2005 | Koyama et al. | 257/59 |
| 7,091,936 | B1 * | 8/2006 | Yamada | 345/76 |
| 2001/0035863 | A1 | 11/2001 | Kimura | |
| 2002/0018060 | A1 * | 2/2002 | Yamazaki et al. | 345/211 |
| 2002/0021293 | A1 | 2/2002 | Tam | |
| 2002/0033718 | A1 | 3/2002 | Tam | |
| 2002/0047581 | A1 | 4/2002 | Koyama | |
| 2002/0063536 | A1 | 5/2002 | Koyama | |
| 2002/0074948 | A1 * | 6/2002 | Aso | 315/169.3 |
| 2002/0084747 | A1 * | 7/2002 | Fujieda et al. | 313/506 |
| 2002/0097213 | A1 * | 7/2002 | Ozawa et al. | 345/92 |
| 2002/0196206 | A1 | 12/2002 | Kimura | |
| 2003/0098827 | A1 | 5/2003 | Ozawa | |
| 2003/0117083 | A1 | 6/2003 | Koyama | |
| 2003/0197179 | A1 | 10/2003 | Yamazaki | |
| 2003/0231273 | A1 | 12/2003 | Kimura | |
| 2004/0046718 | A1 | 3/2004 | Osame | |
| 2004/0150591 | A1 | 8/2004 | Ozawa | |
| 2005/0012704 | A1 | 1/2005 | Chimura | |
| 2005/0093802 | A1 | 5/2005 | Yamazaki et al. | |

FOREIGN PATENT DOCUMENTS

| | | |
|---|---|---|
| EP | 0 895 219 | 2/1999 |
| EP | 1 031 873 | 8/2000 |
| EP | 1 033 765 | 9/2000 |
| EP | 1 087 366 | 3/2001 |
| EP | 1 096 466 | 5/2001 |
| EP | 1 170 718 | 1/2002 |
| EP | 1 170 719 | 1/2002 |
| GB | 2 360 870 | 10/2001 |
| GB | 2 364 592 | 1/2002 |
| GB | 2 364 593 | 1/2002 |
| JP | 08-78519 | 3/1996 |
| JP | 09-148066 | 6/1997 |
| JP | 10-39791 | 2/1998 |
| JP | 10-214060 | 8/1998 |
| JP | 10-232649 | 9/1998 |
| JP | 10-247735 | 9/1998 |
| JP | 10-312173 | 11/1998 |
| JP | 2001-159878 | 6/2001 |
| JP | 2001222255 A | 8/2001 |
| JP | 2002-151276 A | 5/2002 |
| WO | WO 98/33165 | 7/1998 |
| WO | WO 98/36407 | 8/1998 |
| WO | WO 01/75853 | 10/2001 |
| WO | WO 02/05254 | 1/2002 |
| WO | WO 02/05255 | 1/2002 |

OTHER PUBLICATIONS

International search report (International application No. PCT/JP03/11304) dated Oct. 28,2003; 6 pages.

Office Action (Korean Patent Application No. 2003-0053355) dated Oct. 30, 2009 with full English translation.

* cited by examiner

Fig.6A
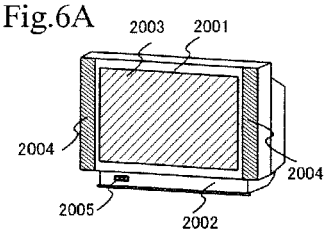
Fig.6B
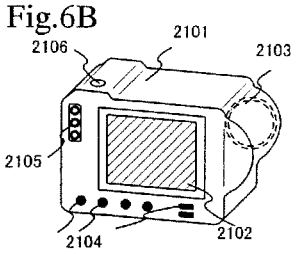
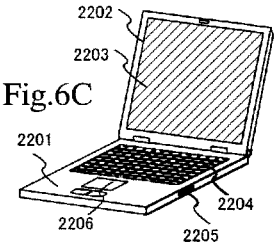
Fig.6C
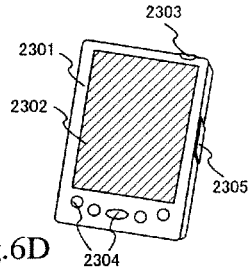
Fig.6D
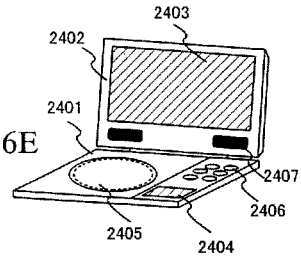
Fig.6E
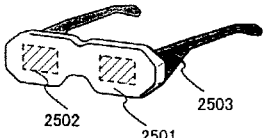
Fig.6F
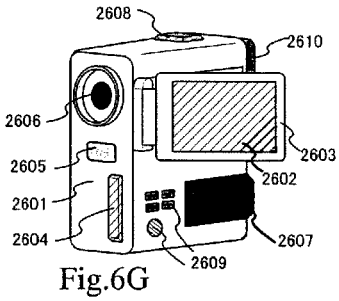
Fig.6G
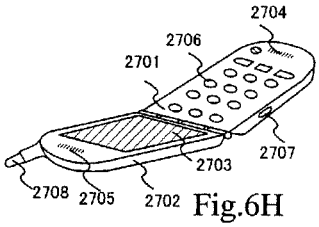
Fig.6H

LIGHT EMITTING DEVICE

BACKGROUND OF THE INVENTION

1. Field of the Invention

The present invention relates to a light emitting device provided with a light emitting element and a means for supplying electric current to the light emitting element in each of a plurality of pixels.

2. Description of the Related Art

There will be described a structure of a pixel in a general light emitting device and a driving method thereof. A pixel shown in FIG. 5A has TFTs 80 and 81, a capacitor 82, and a light emitting element 83. It is not always necessary to provide the capacitor 82.

The TFT 81 has a gate connected to a gate line 85, one of a source and a drain connected to a source line 84, and the other connected to a gate of the TFT 81. The TFT 81 has a source connected to a power source line 86 and a drain connected to an anode of the light emitting element 83. The capacitor 82 is provided in order to keep voltage between the gate and the source of the TFT 81. To each of the power source line 86 and a cathode of the light emitting element 83, a predetermined voltage is given from a power source to have a potential difference each other.

It is noted that a connection in the present specification means an electrical connection, providing no specific notice is mentioned.

When the TFT 80 is turned on in accordance with an electric potential of the gate line 85, an electric potential of a video signal input to the source line 84 is given to the gate of the TFT 81. In accordance with the electric potential of the input video signal, a gate voltage (a potential difference between the gate and the source) of the TFT 81 is determined. Then, a drain current that flows in accordance with the gate voltage is supplied to the light emitting element 83 and the light emitting element 83 emits light in accordance with the supplied electric current.

A structure of a pixel in a general light emitting device, which is different from FIG. 5A, is shown in FIG. 5B. The pixel shown in FIG. 5B has TFTs 60, 61, and 67, a capacitor 62, and a light emitting element 63. It is not always necessary to provide the capacitor 62.

The TFT 60 has a gate connected to a first gate line 65, one of a source and a drain connected to a source line 64, and the other connected to a gate of the TFT 61. The TFT 67 has a gate connected to a second gate line 68, one of a source and a drain connected to a power source line 66, and the other connected to the gate of the TFT 61. The TFT 61 has a source connected to the power source line 66 and a drain connected to an anode of the light emitting element 63. The capacitor is provided in order to keep voltage between the gate and the source of the TFT 61. To each of the power source line 66 and a cathode of the light emitting element 63, a predetermined voltage is given from a power source to have a potential difference each other.

When the TFT 60 is turned on in accordance with an electric potential of the first gate line 65, an electric potential of a video signal input to the source line 64 is given to the gate of the TFT 61. In accordance with the electric potential of the input video signal, a gate voltage (a potential difference between the gate and the source) of the TFT 61 is determined. Then, a drain current that flows in accordance with the gate voltage is supplied to the light emitting element 63 and the light emitting element 63 emits light in accordance with the supplied electric current.

In addition, in the pixel shown in FIG. 5B, when the TFT 67 is turned on in accordance with an electric potential of the second gate line 68, an electric potential of the power source line 66 is given to the gate of the TFT 61, and therefore the TFT 61 is turned off and the light emitting element 63 is forced to finish emitting light.

SUMMARY OF THE INVENTION

Now, in many of electroluminescent materials, luminance in emitting red light is generally low, compared to luminance in emitting blue or green light. In the case of applying an electroluminescent material with such characteristic on light emission to a light emitting device, luminance of red light in a displayed image is likely to be naturally low.

Especially, in the case of a color display method of forming three kinds of light emitting elements corresponding to R (red), G (green), and B (blue) respectively, it is difficult to control a balance of white color.

It has been conventionally carried out as a means to use orange light with a shorter wavelength than red light as red light. However, with the means, a purity of red light that a light emitting device displays is low and an image to be displayed as a red image is displayed as orange light as a result.

Then, as a means for controlling the balance of luminance in emitting red, blue, and green light, it is generally employed to make electric current supplied to a pixel different from each other in displaying RGB (red, green, and blue). Specifically, it is possible to make electric current supplied to a pixel different and keep the balance of white light if an electric potential between a power source line and a cathode of a light emitting element is made different for each of RGB.

There was, however, a problem to be solved in the above means. In making an electric potential of the power source line different for each pixel of RGB, it is necessary, in order to completely turned off a TFT for controlling a supply of electric current to the light emitting element, to determine an electric potential of a video signal in accordance with either the power source line with the highest electric potential if the TFT is a p-channel TFT or the power source line with the lowest electric potential if the TFT is an n-channel TFT.

For example, in the case of the pixel shown in FIG. 5A, a higher electric potential (hereinafter referred to as Hi) of the video signal is made to be equal to or more than an electric potential of the power source line 86 so that the TFT 81 is turned off since the TFT 81 is a p-channel TFT. Therefore, the Hi of the video signal is set to be higher than the highest electric potential of the power source lines for RGB in the case of making an electric potential of the power source line different for each of RGB. However, in the case that an electric potential of the power source line corresponding to R is the highest, for example, it is not necessary that the Hi of the video signal in a pixel corresponding to B or G is made to get as high as that in a pixel corresponding to R, and waste power consumption is caused.

In addition, similarly in the case of the pixel shown in FIG. 5B, waste power consumption is caused if the electric potential of the video signal is determined in accordance with the power source line with the highest electric potential in order to turn off the TFT 61. Further, similarly to the case of the p-channel TFT, waste power consumption is naturally caused in the case of the n-channel TFT if a lower electric potential (hereinafter referred to as Lo) of the video signal is determined in accordance with the power source line with the lowest electric potential.

If the electric potential of the video signal is made different for each pixel of RGB in order to suppress power consumption, two more systems becomes necessary on an electric potential supplied from a power source circuit (hereinafter referred to as a power source potential). The pixel shown in FIG. 5A needs at least six systems for Hi and Lo of the video signal, Hi and Lo given to the gate line, the electric potential of the power source line, and a fixed electric potential given to either the anode or the cathode of the light emitting element on the power source potential supplied to a pixel portion. Then, the pixel shown in FIG. 5B needs two more systems for Hi and Lo of the second gate line, in addition to the above six systems. Accordingly, it is not the best way to increase the number of systems on the power source potential supplied to a pixel portion from a power source since a configuration of the power source circuit is made to be complicated.

In view of the above problem, it is an object of the present invention to provide a light emitting device which is able to suppress power consumption while a balance of white light is kept, without making the configuration of the power source circuit complicated.

In the present invention, the same power source potential provides an electric potential of a power source line corresponding to a specific color and one of Hi and Lo of a video signal corresponding to the specific color.

Specifically, a power source potential corresponding to each color of a light emitting element is used as a higher electric potential of two electric potentials of a video signal and an electric potential of the power source line in the case that a transistor for controlling a supply of electric current to the light emitting element is a p-channel TFT. Conversely, a power source potential corresponding to each color of a light emitting element is used as a lower electric potential of two electric potentials of a video signal and an electric potential of the power source line in the case that a transistor for controlling a supply of electric current to the light emitting element is an n-channel TFT.

It is noted that a light emitting device includes a panel in which a light emitting element is sealed and a module in which the panel is provided with a circuit such as IC including a controller.

In accordance with the above means, it is possible to suppress the number of systems on a power source potential and unnecessary to heighten or lower an electric potential of a power source line like the conventional means even if one of Hi and Lo of a video signal is made different in accordance with each corresponding color. Accordingly, it is possible to suppress power consumption while a balance of white light is kept without making the configuration of the power source circuit complicated.

BRIEF DESCRIPTION OF THE DRAWINGS

FIGS. 6A to 6H are diagrams showing examples of electronic apparatuses that employs light emitting devices according to the present invention.

DESCRIPTION OF THE PREFERRED EMBODIMENTS

Embodiment Mode

In the present embodiment mode, there will be descried a configuration of a light emitting device that the common power source potential provides Hi of a video signal and an electric potential of a power source line for each corresponding color of RGB.

Figure 1:
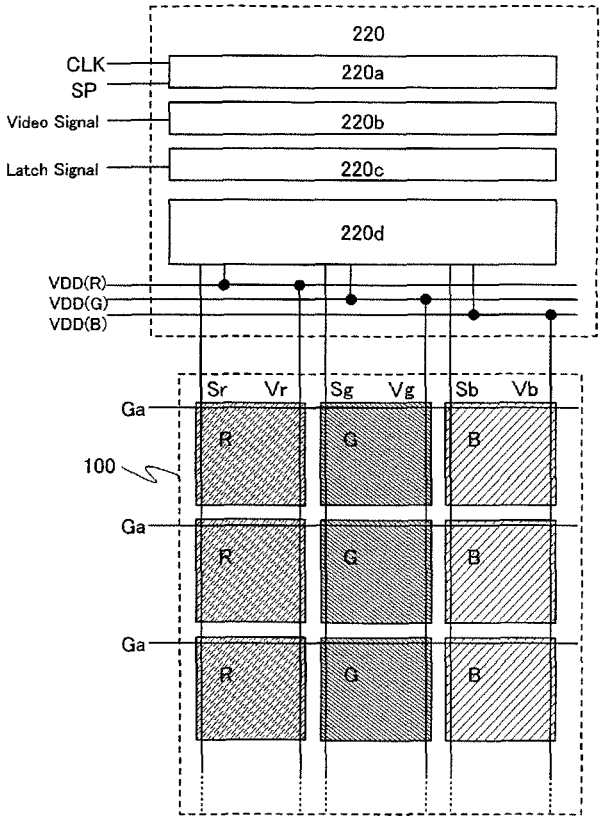
FIG. 1 is a block diagram showing a configuration of a light emitting device according to the present invention.

FIG. 1 is a block diagram that shows configurations of a pixel portion 100 and a source line driving circuit 220 in a light emitting device according to the present invention.

In the pixel portion 100, there are provided pixels each corresponding to R, G or B and an electric potential is given to each pixel from each of a source line, a power source line, and a gate line. An electric potential (specifically, an electric potential of a video signal) given to one source line is given to a plurality of pixels corresponding to the same color, and an electric potential given to one power source line is given to a plurality of pixels corresponding to the same color.

In FIG. 1, source lines corresponding to RGB are denoted by Sr, Sg, and Sb, respectively, and power source lines corresponding to RGB denoted by Vr, Vg, and Vb, respectively. It is noted that the light emitting device of the present invention is not limited on the number of source lines or power source lines, there may be a plurality of source lines or power source lines corresponding to each color. Although FIG. 1 shows the case of three power source lines, the number of power source lines is not limited.

Figure 5A:
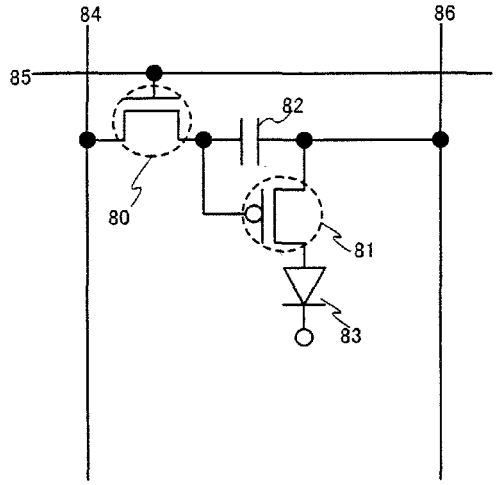
Fig.5A (PRIOR ART)
FIGS. 5A and 5B are circuit diagrams of general pixels.
Figure 5B:
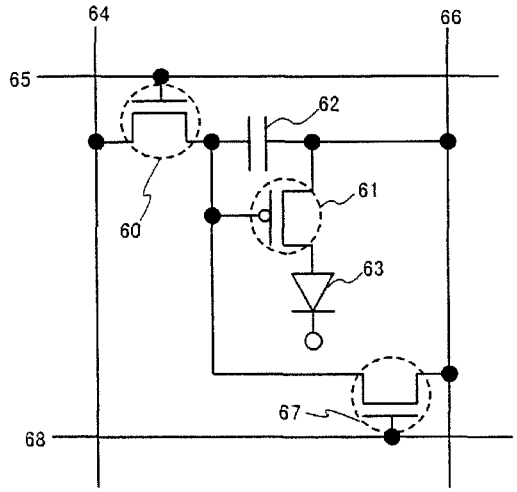
Fig.5B (PRIOR ART)

Although it is assumed in the present embodiment mode that two transistors are provided in the pixel as shown in FIG. 5A, the present invention is not limited to this structure. For example, it may be assumed that three transistors are provided in a pixel as shown in FIG. 5 B. Only what is necessary is that a light emitting device of the present invention is an active matrix light emitting device that is capable of time division gray scale display with digital video signals.

The source line driving circuit 220 shown in FIG. 1 has a shift register 220*a*, a memory circuit A 220*b*, a memory circuit B 220*c*, and a level shifter 220*d*.

In the present embodiment mode, a power source potential VDD (R) supplied from a power source circuit is given to the power source line Vr, and also to the level shifter 220*d* to be used as Hi of a video signal corresponding to R. Similarly, a power source potential VDD (G) supplied from the power source circuit is given to the power source line Vg, and also to the level shifter 220*d* to be used as Hi of a video signal corresponding to G. Also similarly, a power source potential VDD (B) supplied from the power source circuit is given to the power source line Vb, and also to the level shifter 220*d* to be used as Hi of a video signal corresponding to B.

Figure 2A:
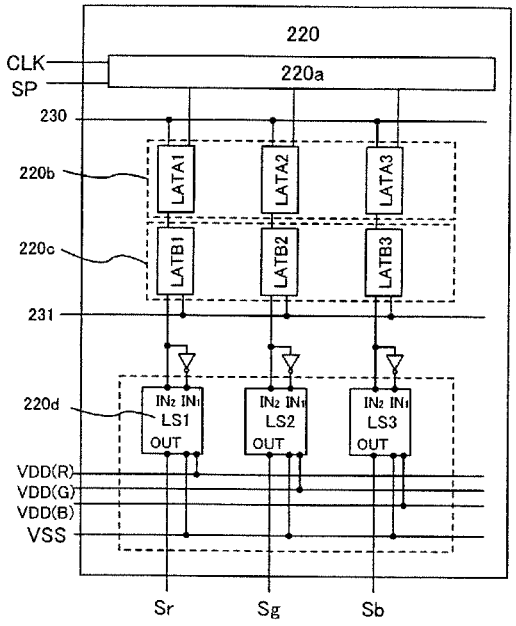
FIGS. 2A and 2B are a block diagram of a source line driving circuit and a circuit diagram of a level shifter.

A block diagram of FIG. 2A shows more detailed structure of the source line driving circuit 220. Hereafter, there will be simply explained on drive of the source line driving circuit 220.

First, when a clock signal CLK and a start pulse signal SP are input to the shift register 220*a*, a timing signal is generated to be input to each of a plurality of latches A (LATA1 to LATA3) held in the memory circuit A 220*b*. At this time, the timing signal generated in the shift register

220*a* may be input to each of the plurality of latches A (LATA1 to LATA3) held in the memory circuit A 220*b* after amplifying the timing signal via a buffering means such as a buffer.

When the timing signal is input to the memory circuit A 220*b*, a bit of video signal input to a video signal line 230 is written into each of the plurality of latches A (LATA1 to LATA3) sequentially and stored therein in accordance with the timing signal. A period of time during once completion of writing video signals into all stages of latches in the memory circuit A 220*b* is called a line period. Actually, there is a case in which the line period refers to a period in which a horizontal retracing period is added to the line period.

After terminating one line period, latch signals are delivered to a plurality of latches B (LATB1 to LATB3) held in the memory circuit B 220*c* via a latch signal line 231. Simultaneously, the video signals stored in the plurality of latches A (LATA1 to LATA3) held in the memory circuit A 220*b* are written all at once into the plurality of latches B (LATB1 to LATB3) held in the memory circuit B 220*c* and stored therein.

After fully delivering the retained video signals to the memory circuit B 220*c*, video signals corresponding to the following one bit are sequentially written into the memory circuit A 220*b* again synchronously in accordance with the timing signal fed from the shift register 220*a*. During the second-round one-line period, the video signals stored in the memory circuit B 220*c* are delivered to the level shifter 220*d*.

The level shifter 220*d* amplifies amplitude of the input video signals before inputting to respective source lines. The power source potential VDD corresponding to each color is used for amplifying the amplitude of the video signals.

Figure 2B:
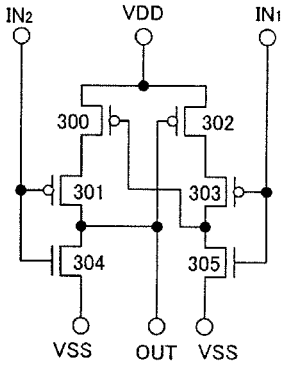

One example of a level shifter is shown in a circuit diagram of FIG. 2B. The level shifter shown in FIG. 2B has four p-channel TFTs 300 to 303 and two n-channel TFTs 304 and 305 provided.

The power source potential VDD is given to sources of the p-channel TFTs 300 and 302. Further, a drain of the p-channel TFT 300 is connected to a source of the p-channel TFT 301 and a drain of the p-channel TFT 301 is connected to a drain of the n-channel TFTs 304, and a drain of the p-channel TFT 302 is connected to a source of the p-channel TFT 303 and a drain of the p-channel TFT 303 is connected to a drain of the n-channel TFTs 305.

In addition, the power source potential VSS is given to sources of the n-channel TFTs 304 and 305. It is noted that the VDD is larger than the VSS (VSS<VDD).

A gate of the p-channel TFT 300 is connected to the drain of the p-channel TFT 303, and an electric potential $IN_2$ of the video signal from the memory circuit B 220*c* is given to gates of the p-channel TFT 301 and the n-channel TFT 304.

An electric potential $IN_1$ of a signal obtained by inverting a polarity of the video signal from the memory circuit B 220*c* is given to gates of the p-channel TFT 303 and n-channel TFT 305. A gate of the p-channel TFT 302 is connected to the drain of the p-channel TFT 301, and an electric potential of the node is given to each source line as an electric potential of the amplified video signal OUT.

A height of the power source potential VDD given to each level shifter is different in accordance with the corresponding color. In the present embodiment mode, the power source potential VDD (R), the power source potential VDD (G), and the power source potential VDD (B) are given to the level shifter corresponding to R, the level shifter corresponding to G, the level shifter corresponding to B, respectively.

Then, Hi of the amplified video signal output from the level shifter is kept at the same height as the power source potential VDD corresponding to each color, and the amplified video signal is supplied to a pixel corresponding to each color via the source line.

Accordingly, the electric potential of the power source line supplied to each pixel and Hi of the video signal are kept at the same height as the power source potential VDD for the corresponding color.

In a pixel, the electric potential of the video signal is given to a gate of a TFT for controlling electric current supplied to a light emitting element, and the electric potential of the power source line is given to a source of the TFT. Therefore, the electric potential of the source of the TFT is the same as that of the gate thereof so that the TFT is turned off when Hi of the video signal is given to the gate.

Since it is assumed in the present embodiment mode that the TFT for controlling electric current supplied to the light emitting element is a p-channel TFT, the TFT is turned on when Lo of the video signal is given to the gate thereof.

In the case that the TFT for controlling electric current supplied to the light emitting element is an n-channel TFT, the power source potential VSS corresponding to each color is used as Lo of the video signal and the electric potential of the power source line. Specifically, if a height of the power source potential VSS given to the level shifter is changed, it is possible to change Lo of the video signal in accordance with the corresponding color.

It is noted that a source line driving circuit used for the present invention is not limited to the configuration shown in the present embodiment mode. Further, the level shifter in the present embodiment mode is not limited to the configuration shown in FIG. 2B. Another circuit that has a function of selecting a source line, for example, such as a decoder circuit may be used instead of the shift register.

In the case of inputting the video signal output from the LATB held in the memory circuit B 220*c* into a corresponding source line without amplifying by the level shifter, a power source potential used as one of Hi and Lo of the video signal, of electric potentials supplied to the LATB, may be changed in accordance with the corresponding color, and at the same time, the power source potential may be used as an electric potential of the power source line in accordance with the corresponding color. After all, what is necessary in the present invention is that a common power source potential is used as one of Hi and Lo of a video signal and an electric potential of a power source line, and at the same time, a height of the power source potential is different in accordance with the corresponding color.

In the present invention, it is not always necessary that power source potentials corresponding to respective colors are all different from each other, and there may be at least two colors existing that have corresponding power source potentials different from each other.

In accordance with the above means, it is possible to suppress the number of systems on an electric potential supplied from a power source circuit and unnecessary to heighten or lower an electric potential of a power source line like the conventional means even if one of Hi and Lo of a video signal is made different for each corresponding color. Accordingly, it is possible to suppress power consumption while a balance of white light is kept without making the configuration of the power source circuit complicated.

Further, it is possible to suppress the number of connection terminals for electrically connecting a panel with power source lines formed in a printed substrate when a power source potential from a power source circuit is supplied to the source line driving circuit and the power source lines from the common wirings in the panel like the present embodiment mode.

In addition, a buffer may be provided behind the level shifter 220*d* in the source line driving circuit 220 shown in FIG. 2A. In this case, a common power source potential provides a power source potential supplied to the buffer, Hi of a video signal, and a power source potential VDD supplied to a level shifter.

It is noted that a light emitting element in the present invention has a layer (hereinafter referred to as an electroluminescent layer) containing an electroluminescent material that provides luminescence (electro-luminescence) generated by applying electric field, an anode, and a cathode. The electroluminescent layer is provided between the anode and the cathode, and composed of a single layer or a plurality of layers that may include an organic compound or an inorganic compound. The luminescence obtained from the electroluminescent layer includes light emission (fluorescence) in returning to the base state from a singlet excitation state and light emission (phosphorescence) in returning to the base state from a triplet excitation state.

Also, the light emitting element in the present invention may be an element that has luminance controlled by electric current or voltage, and includes elements such as an OLED (Organic Light Emitting Diode) and an MIM electron source element (electron emitting element) used in FED (Field Emission Display).

In addition, a transistor used in a light emitting device according to the present invention may be a transistor formed of single-crystal silicon, a thin film transistor formed of poly-silicon, amorphous silicon, or a transistor formed of organic semiconductor.

EMBODIMENT

Hereafter, an embodiment of the present invention will be described.

Embodiment 1

In the present embodiment, a light emitting device according to the present invention will be described on the whole. The light emitting device according to the present invention includes a panel in which a light emitting element is sealed, a module in which the panel is provided with a controller and an IC including a circuit such as a power source circuit. The panel and the module are both corresponding to one mode of the light emitting device. In the present embodiment, a specific configuration of the module will be described.

Figure 3A:
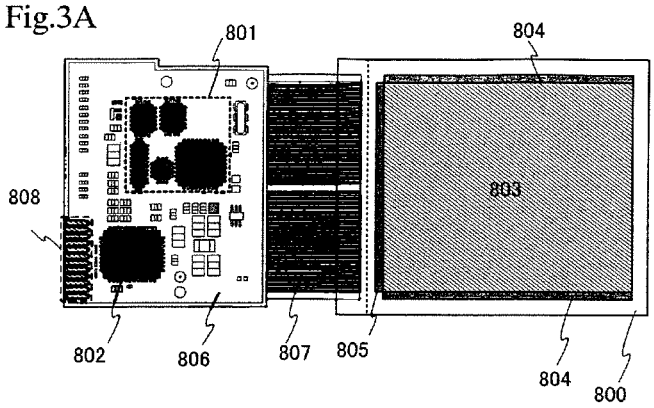
FIGS. 3A and 3B are a diagram showing an appearance of a light emitting device according to the present invention and a block diagram of a controller.

FIG. 3A shows an appearance of a module in which a panel 800 is provided with a controller 801 and a power source circuit 802. There are provided in the panel 800 a pixel portion 803 in which a light emitting element is provided in each pixel, a gate line driving circuit 804 for selecting a pixel in the pixel portion 803, and a source line driving circuit 805 for supplying a video signal to the selected pixel.

The controller 801 and the power source circuit 802 are provided in a printed substrate 806, various kinds of signals and power source potentials output from the controller 801 and the power source circuit 802 are supplied via FPC 807 to the pixel portion 803, the gate line driving circuit 804, and the source line driving circuit 805 of the pixel portion 803.

Via an interface (I/F) 808 in which a plurality of input terminals are arranged, power source potentials and various kinds of signals to the printed circuit 806 is supplied.

Although the printed substrate 806 is attached to the panel 800 with the FPC 807 in the present embodiment, the present invention is not limited to this configuration. The controller 801 and the power source circuit 802 may be provided directly in the panel 800 with a COG (Chip on Class) method.

Further, in the printed circuit 806, there is a case that a capacitor formed between leading wirings and a resistance of a wiring itself cause a noise to a power source potential or a signal, or make a rise of a signal dull. Therefore, it may prevent the noise to the power source potential or a signal and the dull rise of the signal to provide various kinds of elements such as a condenser and a buffer in the printed substrate 806.

Figure 3B:
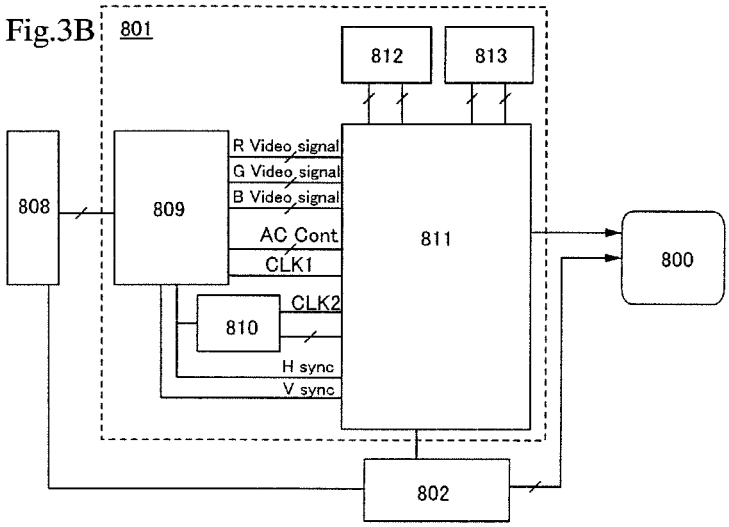

FIG. 3B is a block diagram showing a configuration of the printed substrate 806. Various kinds of signals and power source potentials supplied to the interface 808 are supplied to the controller 801 and the power source circuit 802.

The controller 801 has an A/D converter 809, a phase locked loop (PLL) 810, control signal generating portion 811, and SRAM (Static Random Access Memory) 812 and 813. Although the SRAM is used in the present embodiment, instead of the SRAM, SDRAM can be used and DRAM (Dynamic Random Access Memory) can also be used if it is possible to write in and read out data at high speed.

Video signals supplied via the interface 808 are subjected to a parallel-serial conversion in the A/D converter 809 to be input to the control signal generating portion 811 as video signals corresponding to respective colors of R, G, and B. Further, based on various kinds of signals supplied via the interface 808, H sync signal, V sync signal, clock signal (CLK), and AC cont are generated in the A/D converter 809 to be input into the control signal generating portion 811.

The phase locked loop 810 has a function of synchronizing frequencies of the various kinds of signals supplied via the interface 808 and an operation frequency of the control signal generating portion 811. The operation frequency of the control signal generating portion 811 is not always the same as the frequencies of the various kinds of signals supplied via the interface 808, and adjusted in the phase locked loop 810 in order to synchronize each other.

The video signals input to the control signal generating portion 811 are once written in the SRAM 812 and 813 and stored. In the control signal generating portion 811, a bit of video signal of the all bits of video signals stored in the SRAM 812 is read out for each pixel and input to a source line driving circuit 805 of the panel 800.

Further, in the control signal generating portion 811, information for each bit on a period during which the light-emitting element emits light, is input to a gate line driving circuit 804 of the panel 800.

In addition, the power source circuit 802 supplies a predetermined electric potential to the source line driving circuit 805, the gate line driving circuit 804, and the pixel portion 803 of the panel 800.

Next, a detailed configuration of the power source circuit 802 will be described with FIG. 4. The power source circuit 802 of the present embodiment is composed of a switching regulator 854 that employs four switching regulator controls 860 and a series regulator 855.

In general, a switching regulator is smaller and lighter than a series regulator, and capable of not only step-down but also step-up and inversion of positive and negative. On the other hand, the series regulator is used only for step-down while an output power source potential has a high precision, compared to the switching regulator, and there is almost no possibility for occurrence of a ripple or a noise. The power source circuit 802 in the present embodiment uses the both combined.

Figure 4:
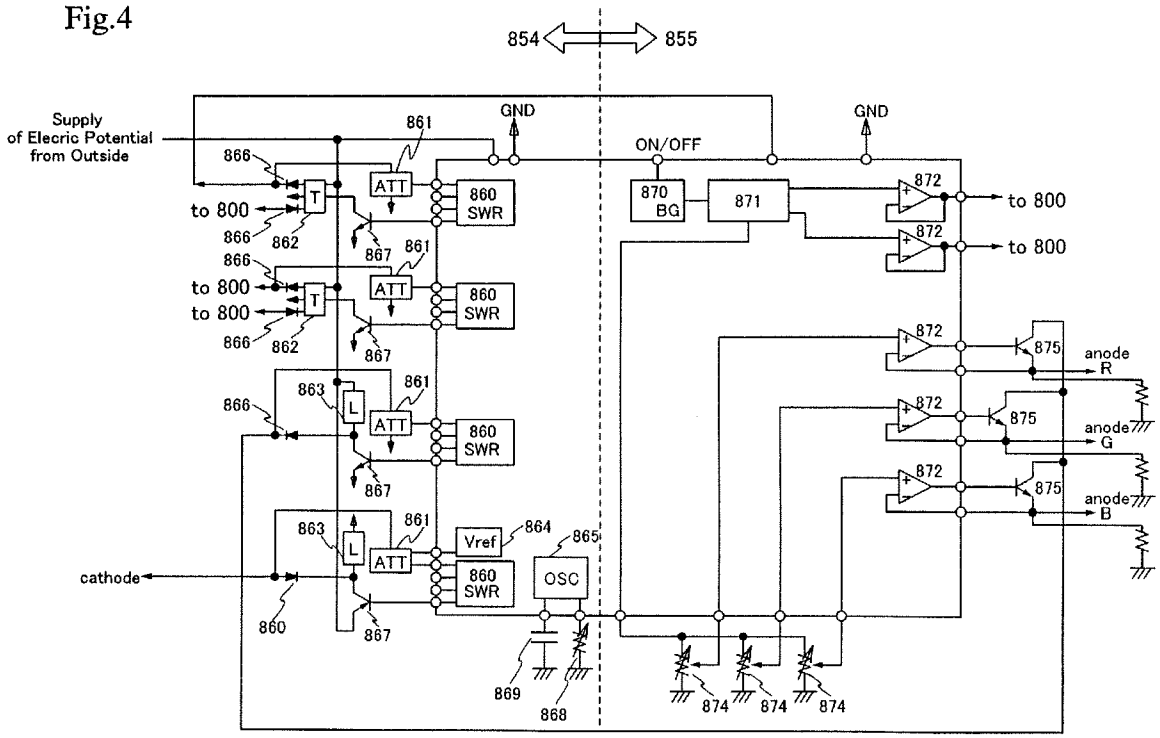
FIG. 4 is a block diagram of a power source circuit.

The switching regulator 854 shown in FIG. 4 has the switching regulator controls (SWR) 860, attenuators (ATT) 861, transformers (T) 862, inductors (L) 863, a reference power source (Vref) 864, an oscillation circuit (OSC) 865, diodes 866, bipolar transistors 867, a variable resistor 868, and a capacitor 869.

When a voltage of such an outside Li ion buttery (3.6 V) is converted in the switching regulator 854, a power source potential given to a cathode and a power source potential supplied to the series regulator 855 are generated.

Further, the series regulator 855 has a band gap circuit (BG) 870, an amplifier 871, operational amplifiers 872, variable resistors 874, and bipolar transistors 875, and the power source potential generated in the switching regulator 854 is supplied thereto.

In the series regulator 855, based on a predetermined electric potential generated in the band gap circuit 870, a direct current of power source potential, used as one of Hi and Lo of a video signal and an electric potential of a power source line for supplying electric current to an anode of a light emitting element corresponding each color, is generated with using the power source potential generated in the switching regulator 854.

In the present invention, the same power source potential provides an electric potential of a power source line corresponding to a specific color and one of Hi and Lo of a video signal corresponding to the specific color. Therefore, it is possible to suppress the number of systems on an electric potential supplied from a power source circuit and make a configuration of the power source circuit simpler even if one of Hi and Lo of a video signal is made different for each corresponding color. Then, since it is unnecessary to heighten or lower an electric potential of a power source line like the conventional means, it is possible to suppress power consumption while a balance of white light is kept without making the configuration of the power source circuit complicated.

Embodiment 2

Electronic apparatuses, each using a light emitting device according to the present invention, include a video camera, a digital camera, a goggles-type display (head mount display), a navigation system, a sound reproduction device (such as a car audio and an audio set), a lap-top computer, a game machine, a portable information terminal (such as a mobile computer, a mobile telephone, a portable game machine, and an electronic book), an image reproduction device including a recording medium (more specifically, an device which can reproduce a recording medium such as a digital versatile disc (DVD) and display the reproduced image), or the like. Specific examples thereof are shown in FIGS. 6A to 6H.

FIG. 6A illustrates a display device which includes a casing 2001, a support table 2002, a display portion 2003, a speaker portion 2004, a video input terminal 2005 and the like. It makes the display device complete to apply the light emitting device according to the present invention to the display portion 2003. The display device includes all display devices for displaying information, such as a personal computer, a receiver of TV broadcasting and an advertising display.

FIG. 6B illustrates a digital still camera which includes a main body 2101, a display portion 2102, an image receiving portion 2103, an operation key 2104, an external connection port 2105, a shutter 2106, and the like. It makes the digital still camera complete to apply the light emitting device according to the present invention to the display portion 2102.

FIG. 6C illustrates a lap-top computer which includes a main body 2201, a casing 2202, a display portion 2203, a keyboard 2204, an external connection port 2205, a pointing mouse 2206, and the like. It makes the lap-top computer complete to apply the light emitting device according to the present invention to the display portion 2203.

FIG. 6D illustrates a mobile computer which includes a main body 2301, a display portion 2302, a switch 2303, an operation key 2304, an infrared port 2305, and the like. It makes the mobile computer complete to apply the light emitting device according to the present invention to the display portion 2302.

FIG. 6E illustrates a portable image reproduction device including a recording medium (specifically, a DVD reproduction device), which includes a main body 2401, a casing 2402, a display portion A 2403, another display portion B 2404, a recording medium (DVD or the like) reading portion 2405, an operation key 2406, a speaker portion 2407 and the like. The display portion A 2403 is used mainly for displaying image information, while the display portion B 2404 is used mainly for displaying character information. The image reproduction device including a recording medium further includes a game machine or the like. It makes the image reproduction device complete to apply the light emitting device according to the present invention to the display portion A 2403 and the display portion B 2404.

FIG. 6F illustrates a goggles-type display (head mounted display) which includes a main body 2501, a display portion 2502, arm portion 2503, and the like. It makes the goggles-type display complete to apply the light emitting device according to the present invention to the display portion 2502.

FIG. 6G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, a viewfinder 2610, and the like. It makes the video camera complete to apply the light emitting device according to the present invention to the display portion 2602.

FIG. 6H illustrates a mobile telephone which includes a main body 2701, a casing 2702, a display portion 2703, a sound input portion 2704, a sound output portion 2705, an operation key 2706, an external connecting port 2707, an antenna 2708, and the like. It is noted that it makes the display portion 2703 reduce power consumption of the mobile telephone to display white-colored characters on a black-colored background. It makes the mobile phone complete to apply the light emitting device according to the present invention to the display portion 2703.

As set forth above, the present invention can be applied widely to electronic apparatuses in various fields. The electronic apparatus in this embodiment may use a light emitting device that has the configuration shown in Embodiment 1.

In the present invention, it is possible to suppress the number of systems on an electric potential supplied from a power source circuit and unnecessary to heighten or lower an electric potential of a power source line like the conventional means even if one of Hi and Lo of a video signal is made different for each corresponding color. Accordingly, it is possible to suppress power consumption while a balance of white light is kept without making the configuration of the power source circuit complicated.

What is claimed is:

1. An active matrix light emitting device comprising:

a source line driving circuit;

a level shifter comprised in the source line driving circuit;

a wiring configured to supply the source line driving circuit and the level shifter with a power source potential;

a pixel portion comprising:

a light emitting element; and a transistor electrically connected to the light emitting element;

a source line electrically connecting the level shifter to the pixel portion; and a power source line electrically connecting the source line driving circuit to the pixel portion, wherein the level shifter is configured to set one of a higher electric potential and a lower electric potential of a video signal input into the source line driving circuit to the power source potential, and wherein the power source line is configured to be set at the power source potential.

2. An electronic apparatus having the active matrix light emitting device according to claim 1, wherein the electronic apparatus is one selected from the group consisting of a video camera, a digital camera, a goggles-type display, a navigation system, a sound reproduction device, a lap-top computer, a game machine, a portable information terminal, and an image reproduction device including a recording medium.

3. An active matrix light emitting device according to claim 1, wherein the transistor comprises a single-crystal silicon.

4. An active matrix light emitting device according to claim 1, wherein the light emitting element is an element selected from the group consisting of an organic light emitting diode and an MIM electron source element.

5. An active matrix light emitting device according to claim 1, further comprising a power source circuit electrically connected to the wiring.

6. An active matrix light emitting device comprising:

a source line driving circuit;

a level shifter comprised in the source line driving circuit;

a first wiring configured to supply the level shifter with a first power source potential and a second wiring configured to supply the level shifter with a second power source potential different from the first power source potential;

a pixel portion comprising:

a first light emitting element;

a second light emitting element;

a first transistor electrically connected to the first light emitting element; and a second transistor electrically connected to the second light emitting element;

a first source line and a second source line each electrically and independently connecting the pixel portion to the level shifter; and a first power source line and a second power source line electrically connecting the pixel portion to the first wiring and to the second wiring, respectively, and wherein the first power source line and the second power source line are configured to be set at the first power source potential and at the second power source potential, respectively.

7. An electronic apparatus having the active matrix light emitting device according to claim 6, wherein the electronic apparatus is one selected from the group consisting of a video camera, a digital camera, a goggles-type display, a navigation system, a sound reproduction device, a lap-top computer, a game machine, a portable information terminal, and an image reproduction device including a recording medium.

8. An active matrix light emitting device according to claim 6, wherein the first transistor and the second transistor comprise single-crystal silicon.

9. An active matrix light emitting device according to claim 6, wherein the first light emitting element and the second light emitting element are selected from the group consisting of an organic light emitting diode and an MIM electron source element.

10. An active matrix light emitting device according to claim 6, wherein the first power source line and the second power source line are configured to provide a first current and a second current to the first light emitting element and to the second light emitting element, respectively;

wherein the first light emitting element and the second light emitting element are configured to emit light of a first color and light of a second color, respectively, the first color and the second color being different from each other; and wherein the first power source potential and the second power source potential depend on the first color and on the second color, respectively.

11. An active matrix light emitting device according to claim 6, wherein the source line driving circuit is configured to set one of a higher electric potential and a lower electric potential of a video signal to the first power source potential of the first wiring.

12. An active matrix light emitting device according to claim 6, further comprising a power source circuit electrically connected to the first wiring and to the second wiring.

13. An active matrix light emitting device comprising:

a source line driving circuit;

a level shifter comprised in the source line driving circuit;

a pixel portion comprising:

a first light emitting element;

a second light emitting element;

a first transistor electrically connected to the first light emitting element; and a second transistor electrically connected to the second light emitting element;

a first source line and a second source line each electrically and independently connecting the pixel portion to the level shifter;

a first power source line electrically connecting the source line driving circuit to the first transistor, the first power source line being configured to be at a first power source potential;

a second power source line electrically connecting the source line driving circuit to the second transistor, the second power source line being configured to be at a second power source potential, the second power source potential being different from the first power source potential, and a first wiring configured to supply the level shifter with the first power source potential and a second wiring configured to supply the level shifter with the second power source potential, wherein the level shifter is configured to set one of a first higher electric potential and a first lower electric potential of a first video signal input into the source line driving circuit to the first power source potential, wherein the level shifter is configured to set one of a second higher electric potential and a second lower electric potential of a second video signal input into the source line driving circuit to the second power source potential, and wherein the first power source line and the second power source line are directly connected to the first wiring and the second wiring, respectively.

14. An electronic apparatus having the active matrix light emitting device according to claim 13, wherein the electronic apparatus is one selected from the group consisting of a video camera, a digital camera, a goggles-type display, a navigation system, a sound reproduction device, a lap-top computer, a game machine, a portable information terminal, and an image reproduction device including a recording medium.

15. An active matrix light emitting device according to claim 13, wherein the first transistor and the second transistor comprise single-crystal silicon.

16. An active matrix light emitting device according to claim 13, wherein the first light emitting element and the second light emitting element are selected from the group consisting of an organic light emitting diode and an MIM electron source element.

17. An active matrix light emitting device according to claim 13, wherein the first light emitting element and the second light emitting element are configured to emit light of a first color and light of a second color, respectively, the first color and the second color being different from each other; and wherein the first power source potential and the second power source potential depend on the first color and on the second color, respectively.

18. An active matrix light emitting device according to claim 13, further comprising a power source circuit electrically connected to the first wiring and to the second wiring.

* * * * *